US005621439A

United States Patent [19]

Okada et al.

[11] Patent Number: 5,621,439

[45] Date of Patent: Apr. 15, 1997

[54] VOLTAGE COMPENSATION CIRCUIT AND DISPLAY APPARATUS

[75] Inventors: Hisao Okada, Nara-ken; Yuji Yamamoto, Kobe; Shigeyuki Uehira, Kashihara, all of Japan

[73] Assignee: Sharp Kabushiki Kaisha, Osaka, Japan

[21] Appl. No.: 268,113

[22] Filed: Jul. 6, 1994

[30] Foreign Application Priority Data

Jul. 6, 1993 [JP] Japan ..... 5-167186
Jul. 4, 1994 [JP] Japan ..... 6-152487

[51] Int. Cl.[6] ..... G09G 5/00

[52] U.S. Cl. ..... 345/211; 345/100

[58] Field of Search ..... 345/211, 212, 345/213, 87, 89, 90, 91, 93, 94, 98, 100, 101

[56] References Cited

U.S. PATENT DOCUMENTS 5,159,326 10/1992 Yamazaki et al. .
5,434,599 7/1995 Hirai et al. ..... 345/100

FOREIGN PATENT DOCUMENTS 0311236 12/1989 European Pat. Off. .
0466506 1/1992 European Pat. Off. .
627900 2/1994 Japan .

*Primary Examiner*—Richard Hjerpe
*Assistant Examiner*—Xiao M. Wu

[57] ABSTRACT

A voltage compensation circuit supplies a desired voltage to a portion to which the desired voltage is to be supplied, by compensating for voltage drops caused by line resistances of voltage supply lines. The voltage compensation circuit includes: a first voltage supply line having a first end; and a second voltage supply line having a second end. In the voltage compensation circuit, a first voltage which is higher than the desired voltage by a predetermined value is applied to the first end, and a second voltage which is lower than the desired voltage by the predetermined value is applied to the second end. The portion to which the desired voltage is to be supplied is connected to the first voltage supply line at a first junction, and the portion to which the desired voltage is to be supplied is connected to the second voltage supply line at a second junction. An amount of voltage drop in the first voltage from the first end to the first junction is substantially equal to an amount of voltage rise in the second voltage from the second end to the second junction.

16 Claims, 10 Drawing Sheets

FIG. 3
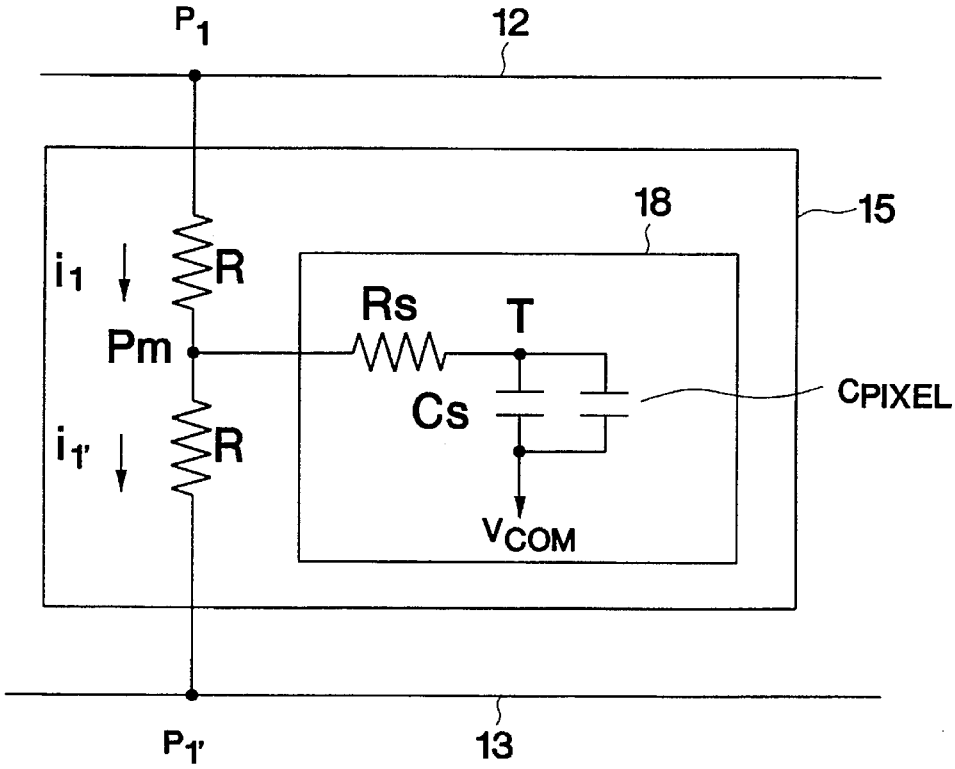
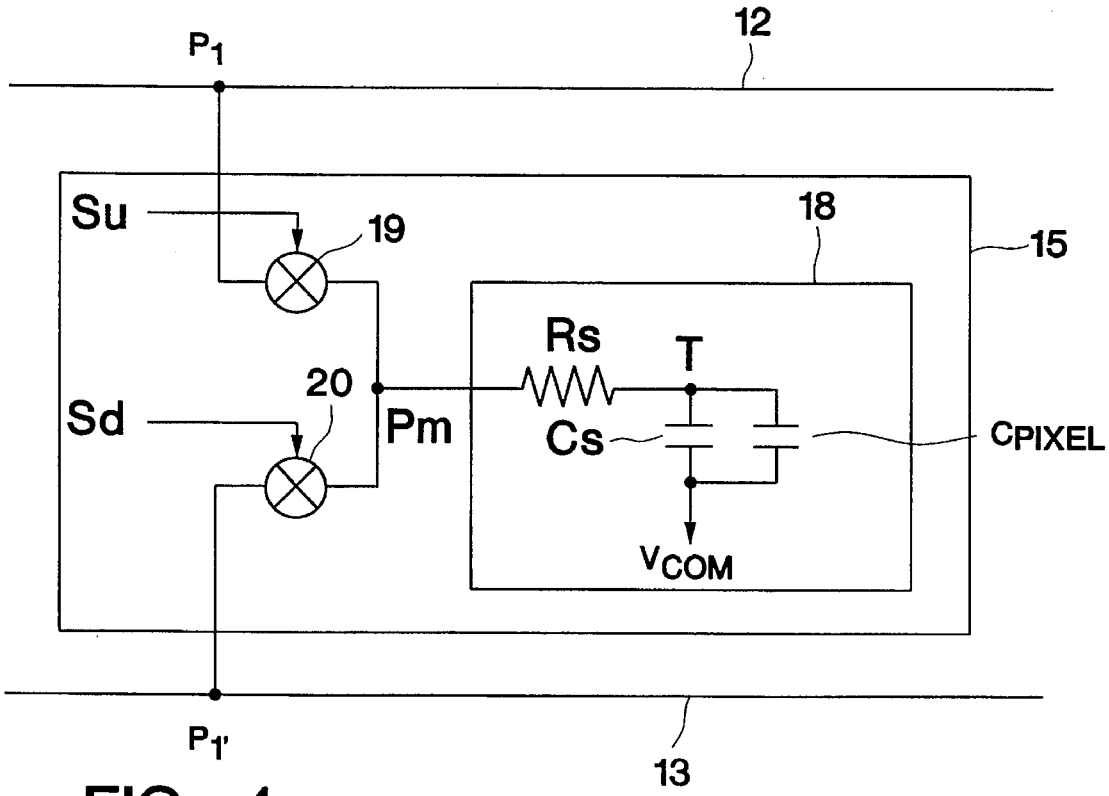
FIG. 4

WHERE $R_u > R_L$

VOLTAGE COMPENSATION CIRCUIT AND DISPLAY APPARATUS

BACKGROUND OF THE INVENTION

1. Field of the Invention

The present invention relates to a voltage compensation circuit for supplying a desired voltage to portions to which the voltage is to be supplied (hereinafter referred to as voltage-supplied portions) by compensating for voltage drops which occur because of line resistances of a voltage supply line. The present invention also relates to a display apparatus, provided with such a voltage compensation circuit, for displaying an image with multiple gray scales.

2. Description of the Related Art

FIG. 13 shows the construction of a conventional liquid crystal display apparatus. The liquid crystal display apparatus includes a liquid crystal display panel 21, a plurality of data drivers 22, and a control power supply circuit 23. The liquid crystal display panel 21 includes a plurality of picture elements (not shown) arranged in a matrix. The plurality of date drivers 22 selectively supply gray-scale voltages to the respective picture elements included in the liquid crystal display panel 21. The control power supply circuit 23 supplies the gray-scale voltages to the respective data drivers 22. The data drivers 22 are not formed on the liquid crystal display panel 21. The control power supply circuit 23 is connected to the substrate 24 via a supply line 25. The data drivers 22 are interconnected with each other via printed wirings (not shown) formed on the substrate 24. The liquid crystal display panel 21 is connected to the data drivers 22 via driving terminals (not shown) of the liquid crystal display panel 21. In order to simplify the description of the construction of the conventional liquid crystal display apparatus, scanning drivers for scanning the picture elements included in the liquid crystal display panel 21 are not shown in FIG. 13.

In the conventional liquid crystal display apparatus having the above-described construction, it is possible to sufficiently reduce the line resistances of the supply line 25 and the printed wirings. Thus, the voltage drops caused by the line resistances of the supply line 25 and the printed wirings become so small that they are negligible. Accordingly, the quality of an image displayed on the liquid crystal display apparatus with multiple gray scales is generally not degraded by the drop of the gray-scale voltage applied to one end of the supply line 25 from the control power supply circuit 23.

However, in the case where the liquid crystal display panel 21 and the voltage supply line form an integrated unit, without using the substrate 24, it is impossible to make the line resistance of the voltage supply line as low as that in the above-described conventional case. As a result, the voltage drop caused by the line resistance of the voltage supply line is not negligible. In this specification, the term "a voltage supply line" is defined as a line which connects a voltage supply circuit to voltage-supplied portions.

The liquid crystal display panel 21 and the voltage supply line form an integrated unit without using the substrate 24 by the following methods.

(1) The method (COG) in which the data drivers 22 are directly connected to a substrate of the liquid crystal display panel 21 without using a tape-automated bonding (TAB) technique or the like.

(2) The method in which thin film transistors (TFTs) of polycrystalline silicon are formed in a substrate of the liquid crystal display panel 21, and also the data drivers 22 are incorporated into the substrate.

Next, referring to FIGS. 14 and 15, the voltage drop caused by the line resistance of the voltage supply line will be described in the case where the liquid crystal display panel 21 and the voltage supply line form an integrated unit.

FIG. 14 shows the distribution of the line resistance of the voltage supply line. In general, a line resistance is a distributed constant circuit, but it can be approximated by using a plurality of concentrated constants. In FIG. 14, the line resistance of the voltage supply line 11 shown in FIG. 14 is represented by 2*n* concentrated constants $r_1$ to $r_{2n}$. Each of the concentrated constants $r_1$ to $r_{2n}$ has a value r. It is assumed that a gray-scale voltage V is applied to one end of the voltage supply line 11, and a current i flows through the voltage supply line 11 in the direction indicated by the arrow in FIG. 14. In this case, the voltage drop at a point $P_s$, which is closest to the source of the gray-scale voltage V, is 0. However, the voltage drop from the point $P_s$ to a point $P_m$, which is positioned between the concentrated constants $r_n$ and $r_{n+1}$, is nri. The voltage drop from the point $P_s$ to a point $P_e$ which is positioned at the other end of the voltage supply line 11 is 2nri.

FIG. 15 shows voltages at respective points on the voltage supply line 11. The voltage $V_s$ at the point $P_s$ is equal to the gray-scale voltage V. On the other hand, the voltage $V_m$ at the point $P_m$ is lower than the gray-scale voltage V by an amount corresponding to the voltage drop (nri). The voltage $V_e$ at the point $P_e$ is lower than the gray-scale voltage V by an amount corresponding to the voltage drop (2nri). The voltage drops at the respective points on the voltage supply line 11 also cause voltage drops in the data drivers 22 which are connected to the respective points on the voltage supply line 11. This results in potential difference between the gray-scale voltage output from a data driver 22 which is closer to the source of the gray-scale voltage V and the gray-scale voltage output from a data driver 22 which is remoter from the source of the gray-scale voltage V. This causes problems in that the resulting image is displayed with various non-uniform gray scales.

SUMMARY OF THE INVENTION

The voltage compensation circuit of the invention supplies a desired voltage to a portion to which the desired voltage is to be supplied, by compensating for voltage drops caused by line resistances of voltage supply lines. The voltage compensation circuit includes: a first voltage supply line having a first end; and a second voltage supply line having a second end, wherein a first voltage, which is higher than the desired voltage by a predetermined value, is applied to the first end, and a second voltage, which is lower than the desired voltage by the predetermined value, is applied to the second end, and the portion to which the desired voltage is to be supplied is connected to the first voltage supply line at a first junction, the portion to which the desired voltage is to be supplied is connected to the second voltage supply line at a second junction, and an amount of voltage drop in the first voltage from the first end to the first junction is substantially equal to an amount of voltage rise in the second voltage from the second end to the second junction.

In one embodiment of the voltage compensation circuit of the invention, the line resistance of the first voltage supply line is substantially equal to the line resistance of the second voltage supply line.

According to another aspect of the invention, a voltage compensation circuit for supplying a desired voltage to a portion to which the desired voltage is to be supplied, by compensating for a voltage drop caused by a line resistance of a voltage supply line is provided. The voltage compensation circuit includes: a voltage supply line having an end, wherein an oscillating voltage which oscillates between a first voltage which is higher than the desired voltage by a predetermined value and a second voltage which is lower than the desired voltage by the predetermined value is applied to the end, and the portion to which the desired voltage is to be supplied is connected to the voltage supply line at a junction.

In one embodiment of the voltage compensation circuit of the invention, the oscillating voltage is a voltage which oscillates between the first voltage and the second voltage at a duty ratio of 1:1.

According to another aspect of the invention, a display apparatus, in which a desired gray-scale voltage is applied to a picture element by compensating for a voltage drop caused by a line resistance of a voltage supply line, is provided. The display apparatus includes: a display section including a picture element and a data line connected to the picture element; a first voltage supply line having a first end; a second voltage supply line having a second end; a voltage supply circuit for applying a first voltage which is higher then the desired gray-scale voltage by a predetermined value to the first end, and for applying a second voltage which is lower than the desired gray-scale voltage by the predetermined value to the second end; and a driving circuit for outputting a driving voltage to the data line, the driving circuit being connected to the first voltage supply line at a first junction and connected to the second voltage supply line at e second junction, wherein an amount of voltage drop in the first voltage from the first end to the first junction is substantially equal to an amount of voltage rise in the second voltage from the second end to the second junction.

In one embodiment of the invention, the first voltage and the second voltage are supplied to the driving circuit, and the driving circuit includes output means for outputting both the first voltage and the second voltage to the data line during the same time period.

In another embodiment of the invention, the first voltage and the second voltage are supplied to the driving circuit, and the driving circuit includes output means for alternately outputting the first voltage and the second voltage to the data line at a predetermined cycle.

In another embodiment of the display apparatus of the invention, the line resistance of the first voltage supply line is substantially equal to the line resistance of the second voltage supply line.

According to still another aspect of the invention, a display apparatus, in which a desired gray-scale voltage is applied to a picture element by compensating for a voltage drop caused by a line resistance of a voltage supply line, is provided. The display apparatus includes: a display section including a picture element and a date line connected to the picture element; a voltage supply line having an end; a voltage supply circuit for applying an oscillating voltage which oscillates between a first voltage which is higher than the desired gray-scale voltage by a predetermined value and a second voltage which is lower than the desired gray-scale voltage by the predetermined value to the end; and a driving circuit for outputting a driving voltage to the data line, the driving circuit being connected to the voltage supply line at a junction.

In one embodiment of the display apparatus of the invention, the oscillating voltage is a voltage which oscillates between the first voltage and the second voltage at a duty ratio of 1:1.

Thus, the invention described herein makes possible the advantages of (1) providing a voltage compensation circuit which supplies a desired voltage to voltage-supplied portions by compensating for the voltage drop caused by the line resistance of the voltage supply line, and (2) providing a display apparatus capable of displaying images with continuous and smooth gray scales.

These and other advantages of the present invention will become apparent to those skilled in the art upon reading and understanding the following detailed description with reference to the accompanying figures.

BRIEF DESCRIPTION OF THE DRAWINGS

FIG. 3 is an equivalent circuit diagram of a voltage-supplied portion.

FIG. 4 is another equivalent circuit diagram of the voltage-supplied portion.

DESCRIPTION OF THE PREFERRED EMBODIMENTS

Figure 1:
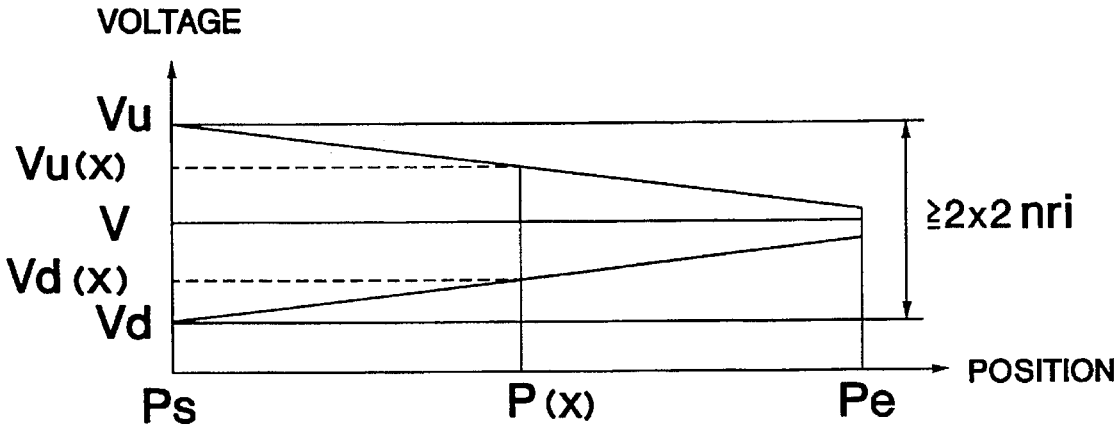
FIG. 1 shows the principle for compensating for a voltage drop caused by a line resistance of a voltage supply line.

First, referring to FIG. 1, the principle for compensating for a voltage drop caused by a line resistance of the voltage supply line is described.

As shown in FIG. 1, it is assumed that a voltage $V_u$, which is higher than a desired voltage V by a predetermined value, is applied to one end point $P_s$ of the voltage supply line, so that a current i flows from the point $P_s$ to the other end point $P_e$ of the voltage supply line. In this case, the longer the distance from the point $P_s$ is, the larger the voltage drop caused by the line resistance of the voltage supply line becomes. For example, the voltage at the point $P_e$ is lower then the voltage $V_u$ by an amount corresponding to the voltage drop (2nri).

In another case, it is assumed that a voltage $V_d$, which is lower than a desired voltage V by a predetermined value, is applied to the point $P_s$ of the voltage supply line, so that a current i flows from the point $P_e$ to the point $P_s$ In this case, the voltage drop due to the current i corresponds to the voltage rise with respect to the voltage $V_d$. As a result, the longer the distance from the point $P_s$ is, the larger the voltage rise becomes. For example, the voltage at the point $P_e$ is higher than the voltage $V_d$ by an amount corresponding to the voltage rise (2nri).

When a point which is distant from the point $P_s$ by a distance x is represented by P(x), the voltage $V_u(x)$ and the voltage $V_d(x)$ at the point P(x) are symmetric with respect to a voltage V which is obtained by the arithmetical mean of the voltages $V_u$ and $V_d$ (i.e., $V=(V_u+V_d)/2$).

Accordingly, if a voltage which is obtained for a point P(x) on the voltage supply line by the arithmetical mean of the voltages $V_u(x)$ and $V_d(x)$ (i.e., $(V_u(x)+V_d(x))/2$) is supplied to voltage-supplied portions, it is possible to supply a desired voltage V ($=(v_u+V_d)/2$) at any point along the voltage supply line.

The difference between the voltage $V_u$ and the voltage $V_d$ should be equal to or larger than the sum of the maximum voltage drop (2nri) for the voltage $V_u$ and the maximum voltage rise (2nri) for the voltage $V_d$. That is, the voltages $V_u$ and $V_d$ are predetermined so as to satisfy the condition of $(V_u-V_d)\leqq 2\times 2nri$.

Next, a construction of a voltage compensation circuit for supplying the desired voltage V, to the voltage-supplied portions based on the above-described principle for compensating for the voltage drop shown in FIG. 1 will be described.

Figure 2:
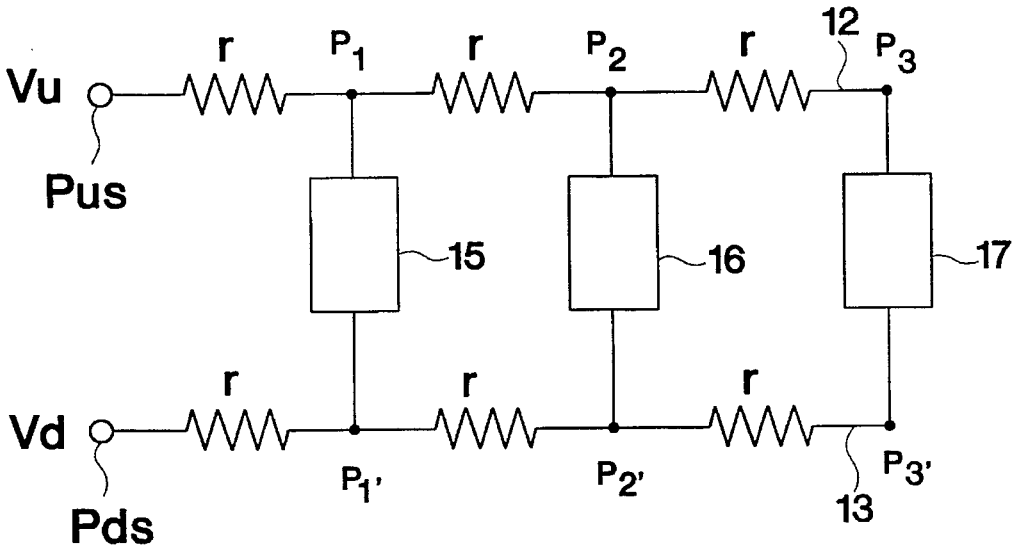
FIG. 2 is a diagram showing the construction of a voltage compensation circuit for supplying a desired gray-scale voltage to voltage-supplied portions by using two voltage supply lines.

FIG. 2 shows the construction of an exemplary voltage compensation circuit. The voltage compensation circuit includes voltage supply lines 12 and 13. In this example, for simplicity, three voltage-supplied portions 15, 16, and 17 are connected to the voltage supply line 12 at three points $P_1$, $P_2$, and $P_3$, respectively, and are connected to the voltage supply line 13 at three points $P_1'$, $P_2'$, and $P_3'$, respectively. However, this invention is not limited by the number of voltage-supplied portions which are connected to the voltage supply lines 12 and 13. The voltage $V_u$ is applied to one end point $P_{us}$ of the voltage supply line 12, and the voltage $V_d$ is applied to one end point $P_{ds}$ of the voltage supply line 13. In general, each of the line resistance of the voltage supply line 12 and the line resistance of the voltage supply line 13 is a distributed constant circuit. In FIG. 2, for simplicity, the line resistance is represented by using a plurality of concentrated constants. Each of the line resistance between the points $P_{us}$ and $P_1$, the line resistance between the points $P_1$ and $P_2$, and the line resistance between the points $P_2$ and $P_3$ is represented by a concentrated constant r. Each of the line resistance between the points $P_{ds}$ and $P_1'$, the line resistance between the points $P_1'$ and $P_2'$, and the line resistance between the points $P_2'$ and $P_3'$ is represented by a concentrated constant r.

It is assumed that a current $i_1$ flows from the voltage supply line 12 to the voltage-supplied portion 15. In this case, the voltage drop at the voltage-supplied portion 15 based on the current $i_1$ As $r\cdot i_1$. If a current having the same amount of value as that of the current $i_1$ flows from the voltage-supplied portion 15 to the voltage supply line 13, a voltage rise of $r\cdot i_1$ occurs on the voltage supply line 13 due to the current. In this case, the voltage $V_{p1u}$ at the point $P_1$ and the voltage $V_{p1d}$ at the point $P_1'$ are expressed by Expression (1) below.

$$V_{p1u}=V_u-r\cdot i_1$$

$$V_{p1d}=V_d+r\cdot i_1 \tag{1}$$

Therefore, the arithmetical mean of the voltages $V_{p1u}$ and $V_{p1d}$ is equal to the arithmetical mean of the voltages $V_u$ and $V_d$ as expressed in Expression (2) below.

$$V_{P1}=\frac{V_{P1u}+V_{P1d}}{2}=\frac{V_u+V_d}{2} \tag{2}$$

In the same way, when the current $i_1$ flows from the voltage supply line 12 to the voltage-supplied portion 15, a current $i_2$ flows from the voltage supply line 12 to the voltage-supplied portion 16, and a current $i_3$ flows from the voltage supply line 12 to the voltage-supplied portion 17, a current $(i_1+i_2+i_3)$ flows through the resistance r between the points $P_{us}$ and $P_1$. Accordingly, the voltage drop at the voltage-supplied portion 15 based on the current $(i_1+i_{2+i3})$ becomes $r\cdot(i_1+i_2+i_3)$. If a current having the same amount of value as that of the current $(i_1+i_2+i_3)$ flows from the voltage-supplied portion 15 to the voltage supply line 13, the voltage rise $r\cdot(i_1+i_2+i_3)$ occurs on the voltage supply line 13 due to this current. As understood, the arithmetical mean of the voltages $V_{p1u}$ and $V_{p1d}$ is equal to the arithmetical mean of the voltages $V_u$ and $V_d$. Similarly, as to the voltage-supplied portions 16 and 17, it is apparent that the arithmetical mean of the voltage $v_{P2u}$ at the point $P_2$ and the voltage $V_{p2d}$ at the point $P_2'$ is equal to the arithmetical mean of the voltages $V_u$ and $V_d$, and the arithmetical mean of the voltage $V_{P3u}$ at the point $P_3$ and the voltage $V_{p3d}$ at the point $P_3'$ is equal to the arithmetical mean of the voltages $V_u$ and $V_d$.

As described above, by combining a pair of voltage supply lines with a voltage-supplied portion which is connected to the respective voltage supply lines and satisfies a predetermined condition, a desired voltage can be supplied to the voltage-supplied portion, irrespective of the positions at which the voltage-supplied portion is connected to the voltage supply lines. The predetermined condition which should be satisfied by the voltage-supplied portion is that the amount of voltage drop with respect to the voltage $V_u$ based on the current flowing from one voltage supply line to the voltage-supplied portion is substantially equal to the amount of voltage rise with respect to the voltage $V_d$ based on the current flowing from the voltage-supplied portion to the other voltage supply line. It is appreciated that the absolute values of the current flowing from one voltage supply line to the voltage-supplied portion, end the current flowing from the voltage-supplied portion to the other voltage supply line are not necessarily required to be equal to each other, so long as the predetermined condition is satisfied. For example, in FIG. 2, in the case where the line resistance between respective points on the voltage supply line 13 is not r but 2r, the voltage-supplied portion should be constructed in such a manner that the current $i_1/2$ flows from the voltage-supplied portion to the voltage supply line 13 while the current $i_1$ flows from the voltage supply line 12 to the voltage-supplied portion.

FIG. 3 shows an exemplary equivalent circuit of the voltage-supplied portion 15. The voltage-supplied portions 16 and 17 can also be the equivalent circuits.

The voltage-supplied portion 15 is connected to the voltage supply lines 12 end 13 at the points $P_1$ and $P_1'$, respectively. A load 18 is connected to a point $P_m$ in the voltage-supplied portion 15. The resistance between the points $P_1$ and $P_m$ is represented by a concentrated constant R. Also, the resistance between the points $P_m$ and $P_1'$ is represented by a concentrated constant R. Hereinafter, it is assumed that the load 18 is a liquid crystal display panel. However, the invention is not limited by the type of device used as the load 18.

The current $i_1$ from the voltage supply line 12 flows to the load 18 through the points $P_1$ and $P_m$, and the current $i_1'$ from the load 18 flows to the voltage supply line 13 through the points $P_m$ and $P_1'$. However, in the steady state, the current flowing into the load 18 is zero, because the potential at the point $P_m$ is identical with the potential at a point T a time when the electric charge to a picture element is finished. At that time, the current from the voltage supply line 12 flows to the voltage supply line 13 through the points $P_1$, $P_m$, and $P_1'$. In this case, $i_1=i_1'$, and accordingly a value of the current flowing from the voltage supply line 12 to the voltage-supplied portion 15 is substantially equal to an absolute value of the current flowing from the voltage-supplied portion 15 to the voltage supply line 13.

Therefore, as shown in FIG. 2, An the case where the line resistance of the voltage supply line 12 between the points $P_{us}$ end $P_1$ is substantially equal to the line resistance of the voltage supply line 13 between the points $P_{ds}$ and $P_1'$, the amount of voltage drop at the point $P_1$ with respect to the voltage $V_u$ is substantially equal to the amount of voltage rise at the point $P_1'$ with respect to the voltage $V_d$, according to the equivalent circuit of the voltage-supplied portion 15 shown in FIG. 3. In other words, when the amount of voltage drop is indicated by $\Delta V$, the voltage at the point $P_1$ is indicated by $(V_u-\Delta V)$, and the voltage at the point $P_1'$ is indicated by $(V_d+\Delta V)$. To the load 18, the arithmetical mean of the voltage at the point $P_1$ and the voltage at the point $P_1'$ is applied. As a result, the voltage $(V_u+V_d)/2$ is applied to the load 18.

FIG. 4 shows another exemplary equivalent circuit of the voltage-supplied portion 15. Each of the voltage-supplied portions 16 end 17 can be such an equivalent circuit.

The point $P_1$ is connected to a signal input of an analog switch 19. The point $P^{1'}$ is connected to a signal input of an analog switch 20. The outputs of the analog switches 19 and 20 ere both connected to the point $P_m$. The point $P_m$ is connected to the load 18.

To the control input of the analog switch 19, a control signal $S_u$ is input. To the control input of the analog switch 20, a control signal $S_d$ is input. The ON/OFF states of the analog switches 19 end 20 are controlled in accordance with the received control signals, respectively.

When the analog switches 19 and 20 are controlled so that both of the analog switches 19 and 20 are in the ON state for the same predetermined time period, the equivalent circuit of the voltage-supplied portion 15 shown in FIG. 4 functions similarly to the equivalent circuit of the voltage-supplied portion 15 shown in FIG. 3. This is because, the ON resistances of the analog switches 19 and 20 serve as the resistances R shown in FIG. 3. Instead of or in addition to the ON resistances of the analog switches 19 and 20, if an appropriate resistance is inserted directly before or after the analog switches 19 end 20, the same effects can be obtained. As a result, the voltage $(V_u+V_d)/2$ is applied to the load 18.

When the analog switches 19 and 20 are controlled so that the analog switches 19 and 20 are alternately and repeatedly turned ON and OFF, an oscillating voltage which oscillates between the voltage $V_{p1}$ at the point $P_1$ and the voltage $V_{p1}'$ at the point $P_1'$ at a predetermined cycle appears at the point $P_m$. In the case where the oscillating voltage oscillates a plurality of times in one output period, the picture element is charged by a mean voltage of the voltages $V_{p1}$ and $V_{p1}'$, which is disclosed in Japanese Laid-Open Patent Publication No. 6-27900. The disclosure of this publication is incorporated herein by reference. When the duty ratio of the oscillating voltage is 1:1, the mean value of the voltages $V_{P1}$ and $V_{P1}'$ is $(V_1+V_1')/2$. Herein, one output period means a period in which a data driver outputs a driving voltage to a data line during the corresponding one scanning period.

In a period in which the voltage $V_{P1}$ is applied to the point $P_m$, the potential difference between the point $P_m$ and the point T is $V_{P1}-(V_{p1}+(V_{P1}+V_{P1}')/2=(V_{P1}-V_{P1}')/2$. It is assumed that the resistance from the point $P_m$ to the picture element is approximated by a concentrated constant $R_s$, the current $i_1(=(V_{P1}-V_{P1}')/2R_s)$ flows from the voltage supply line 12 to the load 18. Similarly, in a period in which the voltage $V_{P1}'$ is applied to the point $P_m$, the potential difference between the point $P_m$ and the point T is $V_{p1}'-(V_{P1}+V_{P1}')/2=(V_{P1}'-V_{P1})/2$. Accordingly, if a current flowing from the voltage supply line 13 to the load 18 is indicated by $i_1'$, a relationship of $i_1'=(V_{P1}'-V_{P1})/2R_s=-i_1$ is established. This means that the current $i_1$ flows from the load 18 to the voltage supply line 13.

As described above, according to the equivalent circuit of the voltage-supplied portion 15 shown in FIG. 4, the absolute value of the current flowing from the voltage supply line 12 to the voltage-supplied portion 15 is substantially equal to the absolute value of the current flowing from the voltage-supplied portion 15 to the voltage supply line 13. Therefore, as shown in FIG. 2, in the case where the line resistance of the voltage supply line 12 between the points $P_{us}$ and $P_1$ is substantially equal to the line resistance of the voltage supply line 13 between the points $P_{ds}$ and $P_1'$, the amount of voltage drop at the point $P_1$ with respect to the voltage $V_u$ is substantially equal to the amount of voltage rise at the point $P_1'$ with respect to the voltage $V_d$. In other words, when the amount of voltage drop is indicated by $\Delta V$, the voltage at the point $P_1$ is indicated by $(V_u-\Delta V)$, and the voltage at the point $P_1'$ is indicated by $(V_d+\Delta V)$. As described above, to the picture element, the arithmetical mean of the voltage at the point $P_1$ and the voltage at the point P' is applied. As a result, the voltage $(V_u+V_d)/2$ is applied to the picture element.

In the voltage compensation circuit shown in FIG. 2, the line resistances of the voltage supply lines 12 and 13 are assumed to be represented by concentrated constants. However, the actual voltage supply lines 12 and 13 are distributed constant circuits. Accordingly, the actual value of the current flowing through each of the voltage supply lines 12 and 13 is not constant. The value of the current flowing through each of the voltage supply lines 12 end 13 is varied depending on the distributed capacitances or the branching positions of the voltage supply lines 12 and 13. Therefore, the voltage drop and the voltage rise on the voltage supply lines 12 and 13 are generally expressed by Expression (3) below.

$$\int_0^x \int_0^x \rho(x)dx \cdot i(x)dx \tag{3}$$

where $\rho(x)$ denotes a resistance at a point P(x), which is distant from one end of one of the voltage supply lines 12 and 13 by a distance x, and i(x) denotes a magnitude of a current at the point P(x).

Expression (3) indicates a product of the curvilinear integrals of $\rho(x)$ and i(x) from the distance 0 to the distance x on the respective voltage supply lines 12 and 13.

In addition, the voltage supply lines 12 and 13 for applying the voltage $V_u$ and $V_d$ do not always have the same resistance characteristics. In general, the voltages $V_u(x)$ and $V_d(x)$ at the point P(x) on the voltage supply lines 12 and 13 are expressed by Expression (4) below.

$$V_u(x) = V_u - \int_0^x \int_0^x \rho_u(x)dx \cdot i_u(x)dx \quad (4)$$

$$V_d(x) = V_d + \int_0^x \int_0^x \rho_d(x)dx \cdot i_d(x)dx$$

where $\rho_u(x)$ and $\rho_d(x)$ indicate resistances at the point P(x), which is distant from one end of each of the voltage supply lines 12 and 13 by the distance x, respectively, and $i_u(x)$ and $i_d(x)$ indicate the values of currents at the point P(x), respectively.

If the values of the second terms in the right sides of the equations in Expression (4) (i.e., the amount of the voltage drop and the amount of the voltage rise) are equal to each other as represented by Expression (5) below, it is possible to supply a desired voltage to any voltage-supplied portions, irrespective of the distance x, by obtaining the arithmetical mean of the voltages $V_u(x)$ and $V_d(x)$ at the point P(x) on the voltage supply lines 12 and 13 (see Expression (6).

$$\int_0^x \int_0^x \rho_u(x)dx \cdot i_u(x)dx = \int_0^x \int_0^x \rho_d(x)dx \cdot i_d(x)dx \quad (5)$$

$$V(x) = \frac{V_u(x) + V_d(x)}{2} = \frac{V_u + V_d}{2} \quad (6)$$

It is not necessary that the condition of Expression (5) is satisfied at all points on the voltage supply lines 12 and 13. It is sufficient that the condition of Expression (5) is satisfied for at least the points to which the voltage-supplied portions are connected on the voltage supply lines 12 and 13. In addition, it is not necessary that the distance x on the voltage supply line 12 and the distance x on the voltage supply line 13 are equal to each other, if the condition of Expression (5) is satisfied. For example, in the case where the value of the left side of Expression (5) when $x=x_1$ is equal to the value of the right side of Expression (5) when $x=x_2$, the voltage-supplied portion is connected to the point which is distant from one end of the voltage supply line 12 by the distance $x_1$ and to the point which is distant from one end of the voltage supply line 13 by the distance $x_2$.

If it is assumed that the current $i_u(x)$ is identical with the current $i_d(x)$ for all of the distances x, it is sufficient that the all of the distances x satisfy the condition of Expression (7) below in order to easily satisfy the condition of Expression. (5).

$$\rho_u(x)=\rho_d(x) \quad (7)$$

The condition of Expression (7) means that the voltage supply lines 12 and 13 have the same resistance characteristic. When the voltage supply lines 12 and 13 both have the uniform characteristics, $\rho_u(x)$ and $\rho_d(x)$ become constant.

Next, another construction of a voltage compensation circuit for supplying a desired voltage to voltage-supplied portions based on the principle for compensating for the voltage drop shown in FIG. 1 will be described.

Figure 5:
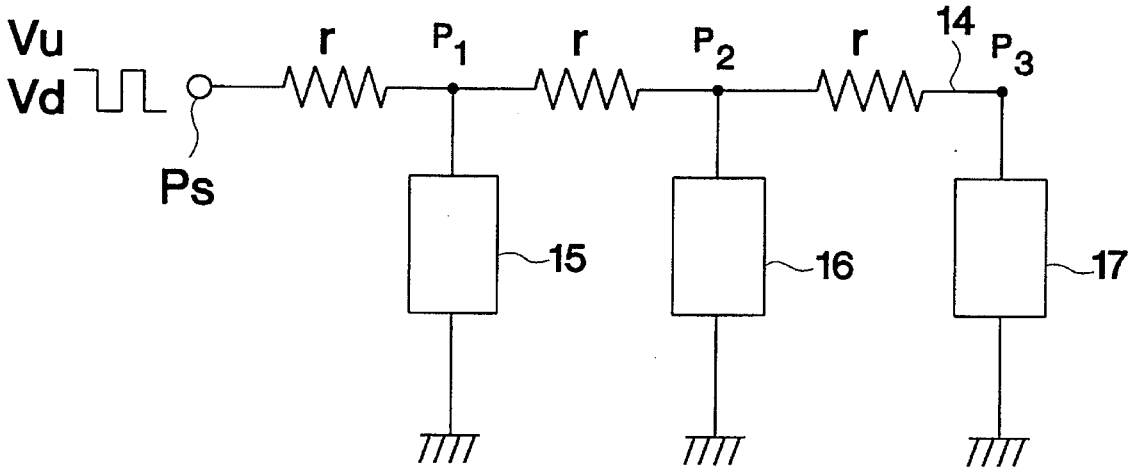
FIG. 5 is a diagram showing the construction of a voltage compensation circuit for supplying a desired gray-scale voltage to voltage-supplied portions by using a single voltage supply line.

FIG. 5 shows the construction of another example of a voltage compensation circuit according to the invention. The voltage compensation circuit includes a voltage supply line 14. In this example, for simplicity, it is assumed that three voltage-supplied portions 15, 16, and 17 are connected to the voltage supply line 14 at three points $P_1$, $P_2$, end $P_3$. However, this invention is not limited by the number of voltage-supplied portions which are connected to the voltage supply line 14. An oscillating voltage which oscillates between the voltages $V_u$ and $V_d$ at a predetermined cycle is applied to one end point $P_s$ of the voltage supply line 14. The line resistance of the voltage supply line 14 is generally a distributed constant circuit. However, in FIG. 5 for simplicity, the line resistance is represented by a plurality of concentrated constants. Each of the line resistance between the points $P_s$ and $P_1$, the line resistance between the points $P_1$ and $P_2$, and the line resistance between the points $P_2$ and $P_3$ is represented by a concentrated constant r.

In the case where a current $i_1$ flows from the voltage supply line 14 to the voltage-supplied portion 15 during a first period in which the voltage $V_u$ is applied to the voltage supply line 14, the voltage drop based on the current $i_1$ during the first period is $r \cdot i_1$. If during a second period in which the voltage $V_d$ is applied to the voltage supply line 14, a current having the same amount of value as that of the current $i_1$ flows from the voltage-supplied portion 15 to the voltage supply line 14, the voltage rise of $r \cdot i_1$ occurs on the voltage supply line 14 due to the current. In this case, an oscillating voltage which oscillates between the voltages $(V_u - r \cdot i_1)$ and $(V_d + r \cdot i_1)$ at a duty ratio of 1:1 appears at the point $P_1$. Therefore, when the voltage-supplied portion 15 is provided with a low pass filter, a voltage which is substantially equal to the mean value of the oscillating voltage appearing at the point $P_1$ can be obtained after the oscillating voltage passes through the low pass filter. The mean value of the oscillating voltage is equal to a constant voltage $(V_u + V_d)/2$ on the basis of Expression (2).

In a similar manner, the oscillating voltage appearing at the point $P_2$ or $P_3$ is made to pass through the low pass filter, so that a voltage which is substantially equal to the constant voltage $(V_u + V_d)/2$ is obtained.

As described above, by combining a single voltage supply line with a voltage-supplied portion which is connected to the voltage supply line and satisfies a predetermined condition, and by applying an oscillating voltage to one end of the voltage supply line, a desired voltage can be supplied to the voltage-supplied portion, irrespective of the position at which the voltage-supplied portion is connected to the voltage supply line. The predetermined condition is that the absolute value of the current $i_1$ flowing from the voltage supply lane to the voltage-supplied portion during the first period in which the voltage $V_u$ is applied to the voltage supply line is substantially equal to the absolute value of the current flowing from the voltage-supplied portion to the voltage supply line during the second period in which the voltage $V_d$ is applied to the voltage supply line.

For example, when the load 18 shown in FIG. 4 is connected to the point $P_1$ as the voltage-supplied portion 15, the load 18 satisfies the predetermined condition mentioned above. The reason is the same as that in the case where, when an oscillating voltage which oscillates at the duty ratio of 1:1 is applied to the point $P_m$ shown An FIG. 4, the current flowing from the voltage supply line 12 to the load 18 is substantially equal to the current flowing from the load 18 to the voltage supply line 13. Therefore, the reason is not described here.

Figure 6:
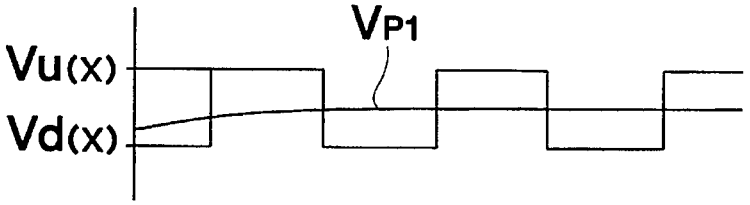
FIG. 6 shows the waveform of an oscillating voltage and the waveform of an average value of the oscillating voltage.

In the case where each of the voltage-supplied portions 15, 16, and 17 includes a picture element and a data line connected thereto included in the liquid crystal display panel, at least one of a set of resistance and capacitance components of the picture element, or a set of resistance and capacitance components of the data line functions as a low pass filter. Accordingly, the oscillating voltage applied to the point $P_1$ is gradually converged to a constant voltage $V_{P1}$ as shown in FIG. 6. In the steady state, the voltage $V_{P1}$ is equivalent to the voltage obtained by the arithmetical mean of the voltages $V_u$ and $V_d$, as represented in Expression (2). As a result, the voltage $V_{P1}$ is applied to the picture element.

In addition, the explanations of the voltage drop and the voltage rise, considering that the actual voltage supply line 14 is a distributed constant circuit, result in that the explanations thereof in the case where the above-described voltage supply lines 12 and 13 have the same resistance characteristics. Therefore, these explanations are omitted herein.

Figure 7:
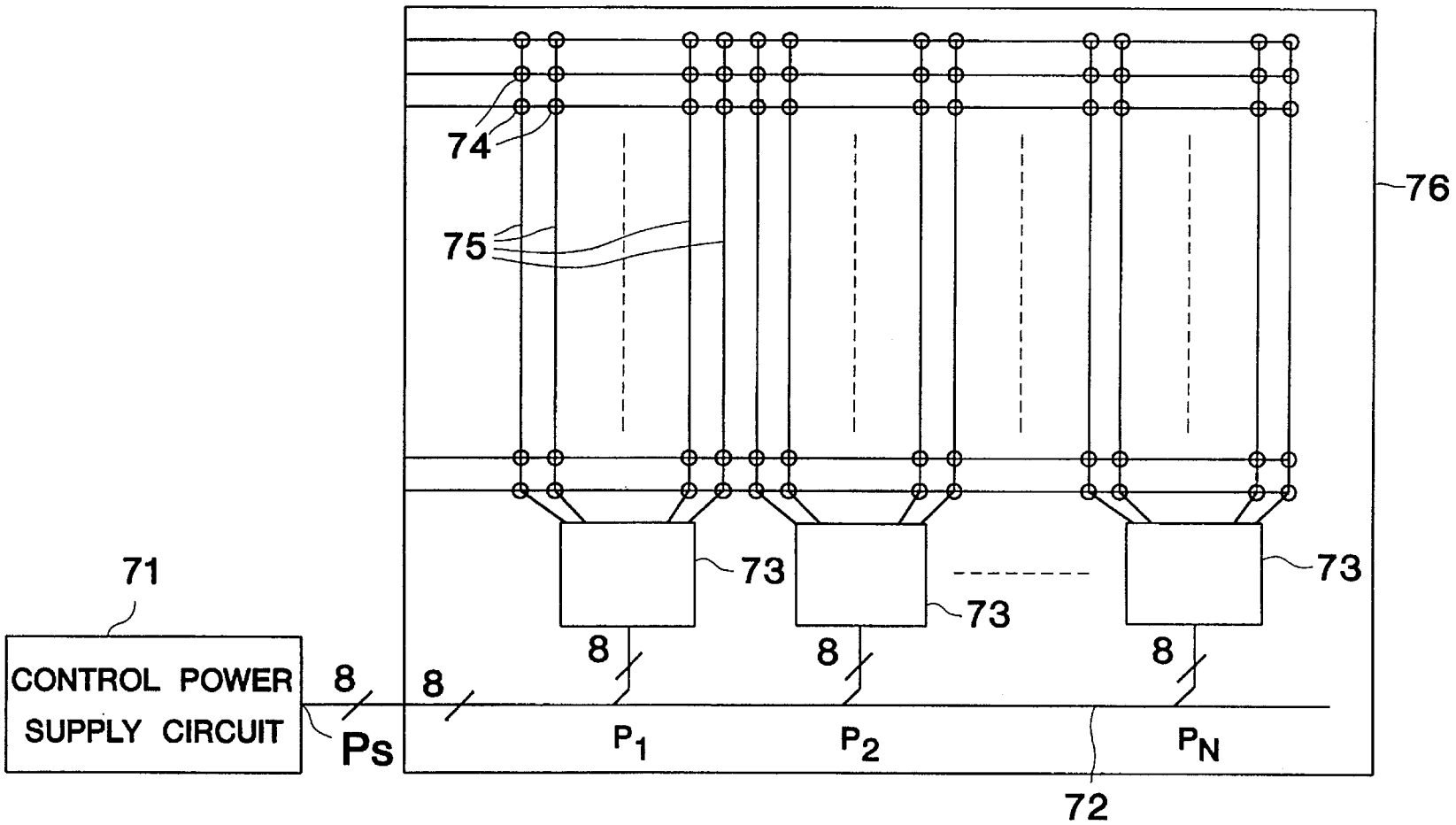
FIG. 7 is a diagram showing the construction of a display apparatus in a first example of the invention.

FIG. 7 shows the construction of a display apparatus An one example of the invention. The display apparatus displays an image with a plurality of levels of gray scales depending on the input gray-scale data. Hereinafter, to simplify the description, it is assumed that the gray-scale data is composed of 2 bits, and the number of levels of the gray scales is 4 ($=2^2$). It is appreciated that the present invention is not limited by the number of bits of the gray-scale data and the number of levels of gray scales.

The display apparatus includes a control power supply circuit 71 for supplying a plurality of gray-scale voltages, four pairs of voltage supply lines 72 connected to the control power supply circuit 71, a plurality of data drivers 73 connected to the four pairs of voltage supply lines 72, a plurality of picture elements 74 arranged in a matrix, and a plurality of data lines 75 respectively connected to the picture elements 74. The four pairs of voltage supply lines 72, the plurality of data drivers 73, the plurality of picture elements 74, and the plurality of data lines 75 are formed on a glass substrate of a liquid crystal display panel 76.

Herein, a voltage-supplied portion shown in FIG. 2 corresponds to a portion including A data driver 73 connected to the four pairs of voltage supply lines 72, a plurality of data lines 75 connected to the data driver, and picture elements 74 connected to the data lines 75.

The four pairs of voltage supply lines 72 consist of a first pair of voltage supply lines ($L_{0u}$, $L_{0d}$), a second pair of voltage supply lines ($L_{1u}$, $L_{1d}$), a third pair of voltage supply lines ($L_{2u}$, $L_{2d}$), and a fourth pair of voltage supply lanes ($L_{3u}$, $L_{3d}$). The first pair of voltage supply lines ($L_{0u}$, $L_{0d}$) have End points ($P_{s0u}$, $P_{s0d}$). The second pair of voltage supply lines ($L_{1u}$, $L_{1d}$) have end points ($P_{s1u}$, $P_{s1d}$). The third pair of voltage supply lines ($L_{2u}$, $L_{2d}$) have end points ($P_{s2u}$, $P_{s2d}$). The fourth pair of voltage supply lines ($L_{3u}$, $L_{3d}$) have end points ($P_{s3u}$, $P_{s3d}$). In FIG. 7, for simplicity, the eight end points $P_{s0u}$, $P_{s0d}$, $P_{s1u}$, $P_{s1d}$, $P_{s2u}$, $P_{s2d}$, $P_{s3u}$, and $P_{s3d}$ are collectively represented as $P_s$. The control power supply circuit 71 applies eight levels of analog voltages $V_{0u}$, $V_{0d}$, $V_{1u}$, $V_{1d}$, $V_{2u}$, $V_{2d}$, $V_{3u}$, and $V_{3d}$ to the eight end points $P_{s0u}$, $P_{s0d}$, $P_{s1u}$, $P_{s1d}$, $P_{s2u}$, $P_{s2d}$, $P_{s3u}$, and $P_{s3d}$, respectively. Each pair of voltage supply lines ($V_{iu}$, $V_{id}$) are used for supplying a desired voltage $V_i$ to the data driver 73. The analog voltage $V_{iu}$ is higher than the desired voltage $V_i$ by a predetermined value. The analog voltage $V_{id}$ is lower than the desired voltage $V_i$ by the predetermined value. The predetermined value is previously set so as to be equal to or larger than the maximum voltage drop with respect to the analog voltage $V_{iu}$. Herein, i=0, 1, 2, and 3.

Each of the plurality of data drivers 73 is connected to the four pairs of voltage supply lines 72 at respective one of the points $P_1$ to $P_N$. Herein, each of the points $P_1$ to $P_N$ collectively indicates the eight end points, as described above. In FIG. 7, each of the plurality of data drivers 73 is shown so as to be connected to the four pairs of voltage supply lines 72 via four pairs of branch lines. However, this figure is merely intended to simply and clearly show the connection of a data driver 73 and the four pairs of voltage supply lines 72. Thus, the line resistances of the four pairs of branch lines from one of the points $P_1$–$P^N$ to the data driver 73 are all zero.

To each of the plurality of data drivers 73, eight levels of analog voltages are supplied from the control power supply circuit 71 via the four pairs of voltage supply lines 72. When the number of data lines 75 connected to one data driver 73 is n, the data driver 73 includes n output circuits. Each of the n output circuits is connected to one data line 75, and outputs a driving voltage to the data line 75 in accordance with the input gray-scale data. The driving voltage is applied to the picture elements 74 via the data line 75.

In order to simplify the description of the construction of the invention, scanning drivers for scanning the plurality of picture elements 74 or signal lines other than the voltage supply lines are not shown in FIG. 7.

In this example, the plurality of data drivers 73 are disposed on one side of the matrix of the picture elements 74. However, the present invention is not limited by the specific location of the data drivers 73. For example, the plurality of data drivers 73 are disposed on the other side of the matrix of the picture elements 74.

FIG. 7, in order to easily understand the invention, the plurality of data drivers 73 are shown so as to be separately disposed from the four pairs of voltage supply lines 72. However, in the actual design, the plurality of data drivers 73 are preferably disposed so as to cover a part of the four pairs of voltage supply lines 72. Such a design will prevent voltage supply lines and lines from the voltage supply lines to data drives from crossing each other on the substrate.

Figure 8:
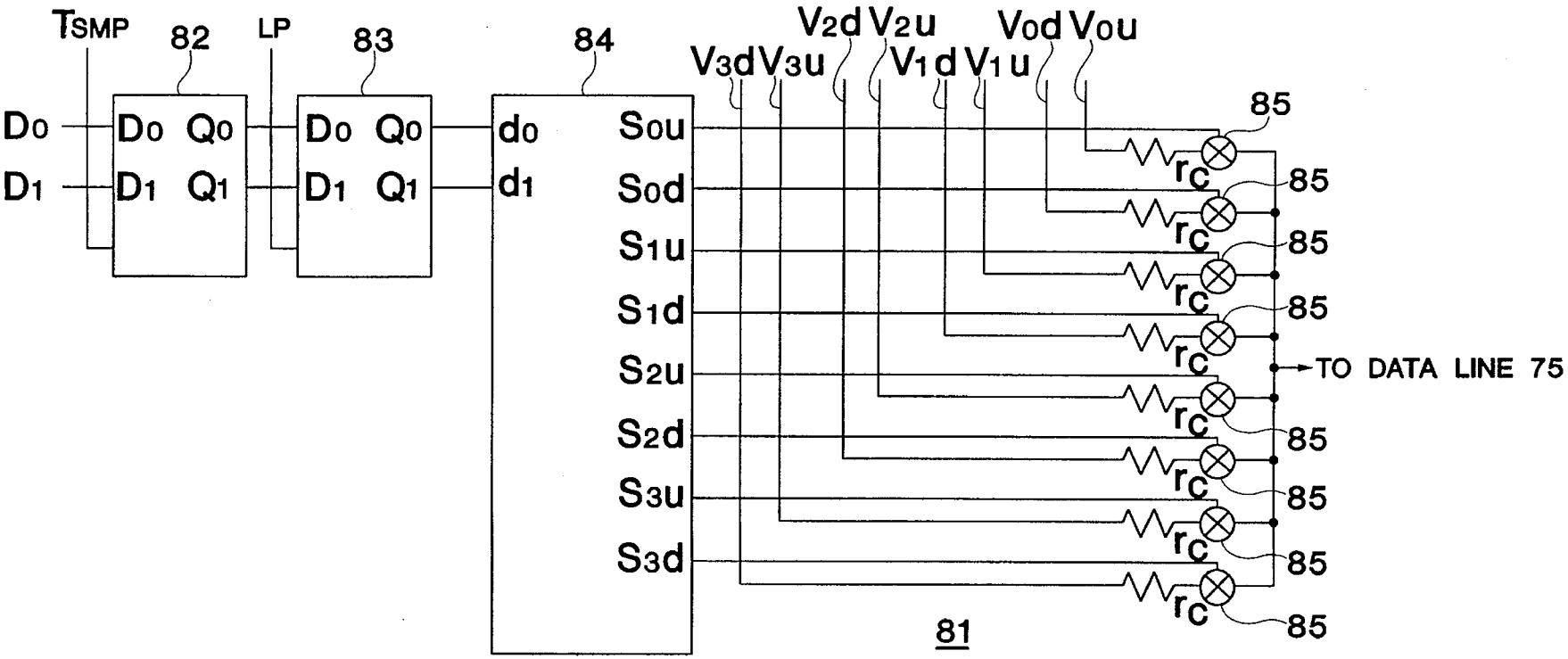
FIG. 8 is a diagram showing part of the construction of a data driver in the first example.

FIG. 8 shows the construction of an output circuit 81 corresponding to one output of the data driver 73.

The output circuit 81 includes a sampling circuit 82 at a first stage, a holding circuit 83 at a second stage, a selection control circuit 84, and eight analog switches 85. A resistance $r_c$ is inserted directly before each of the analog switches 85. Alternatively, the resistance $r_c$ may be inserted directly after each of the analog switches 85. In actuality, each analog switch 85 has its own ON resistance. Thus, if the employed analog switch 85 has an appropriate 0N resistance, the resistance $r_c$ can be omitted.

The output circuit 81 outputs one of four levels of desired gray-scale voltages $V_0$, $V_1$, $V_2$, and $V_3$ to the data line 75, in accordance with the values of the input 2-bit gray-scale data ($D_0$, $D_1$). Herein, $V_0=(V_{0u}+V_{0d})/2$, $V_1=(V_{1u}+V_{1d})/2$, $V_2=(V_{2u}+V_{2d})/2$, and $V_3=(V_{3u}+V_{3d})/2$.

The selection control circuit 84 receives the 2-bit gray-scale data, and outputs a control signal indicating an analog voltage pair to be selected depending on the values of the gray-scale data.

Table 1 below is a logic table indicating the relationship between the values of the gray-scale data ($d_0$, $d_1$) input into the selection control circuit 84 and the control signals ($S_{0u}$, $S_{0d}$, $S_{1u}$, $S_{1d}$, $S_{2u}$, $S_{2d}$, $S_{3u}$, $S_{3d}$) output from the selection control circuit 84. As indicated in Table 1, the selection control circuit 84 outputs a control signal so that any one control signal pair of four control signal pairs ($S_{iu}$ and $S_{id}$; i=0, 1, 2, and 3) is set to be "1" (i.e., become active).

TABLE 1

| $d_0$ | $d_1$ | $S_{0u}$ | $S_{0d}$ | $S_{1u}$ | $S_{1d}$ | $S_{2u}$ | $S_{2d}$ | $S_{3u}$ | $S_{3d}$ |
|---|---|---|---|---|---|---|---|---|---|
| 0 | 0 | 1 | 1 | 0 | 0 | 0 | 0 | 0 | 0 |
| 0 | 1 | 0 | 0 | 1 | 1 | 0 | 0 | 0 | 0 |
| 1 | 0 | 0 | 0 | 0 | 0 | 1 | 1 | 0 | 0 |
| 1 | 1 | 0 | 0 | 0 | 0 | 0 | 0 | 1 | 1 |

The outputs of the selection control circuit 84 are connected to the control inputs of the eight analog switches 85, respectively. Each of the eight analog switches 85 is controlled so that it is turned ON when the value "1" is received at the control input, and it is turned OFF when the value "0" is received at the control input. In another case where the number of outputs of the selection control circuit 84 is four, each of the outputs of the selection control circuit 84 may be connected to paired control inputs of the analog switches 85.

The signal inputs of the eight analog switches 85 are connected to the #our pairs of voltage supply lines 72. Accordingly, eight levels of analog voltages $V_{0u}$, $V_{0d}$, $V_{1u}$, $V_{1d}$, $V_{2u}$, $V_{2d}V_{3u}$, and $V_{3d}$ are input to the analog switches 85 via the four pairs of voltage supply lines 72, respectively.

The selection control circuit 84 operates in accordance with the logic table shown in Table 1. As a result, paired analog switches 85 are in the ON state for the same predetermined time period. Thus, as in the equivalent circuit shown in FIG. 4, the absolute value of the current flowing from the four pairs of voltage supply lines 72 to the output circuit 81 is substantially equal to the absolute value of the current flowing from the output circuit 81 to the four pairs of voltage supply lines 72. Therefore, one of the voltages $(V_{0u}+V_{0d})/2$, $(V_{1u}+V_{1d})/2$, $(V_{2u}+V_{2d})/2$, and $(V_{3u}+V_{3d})/2$ is output to the data line 75.

Figure 9:
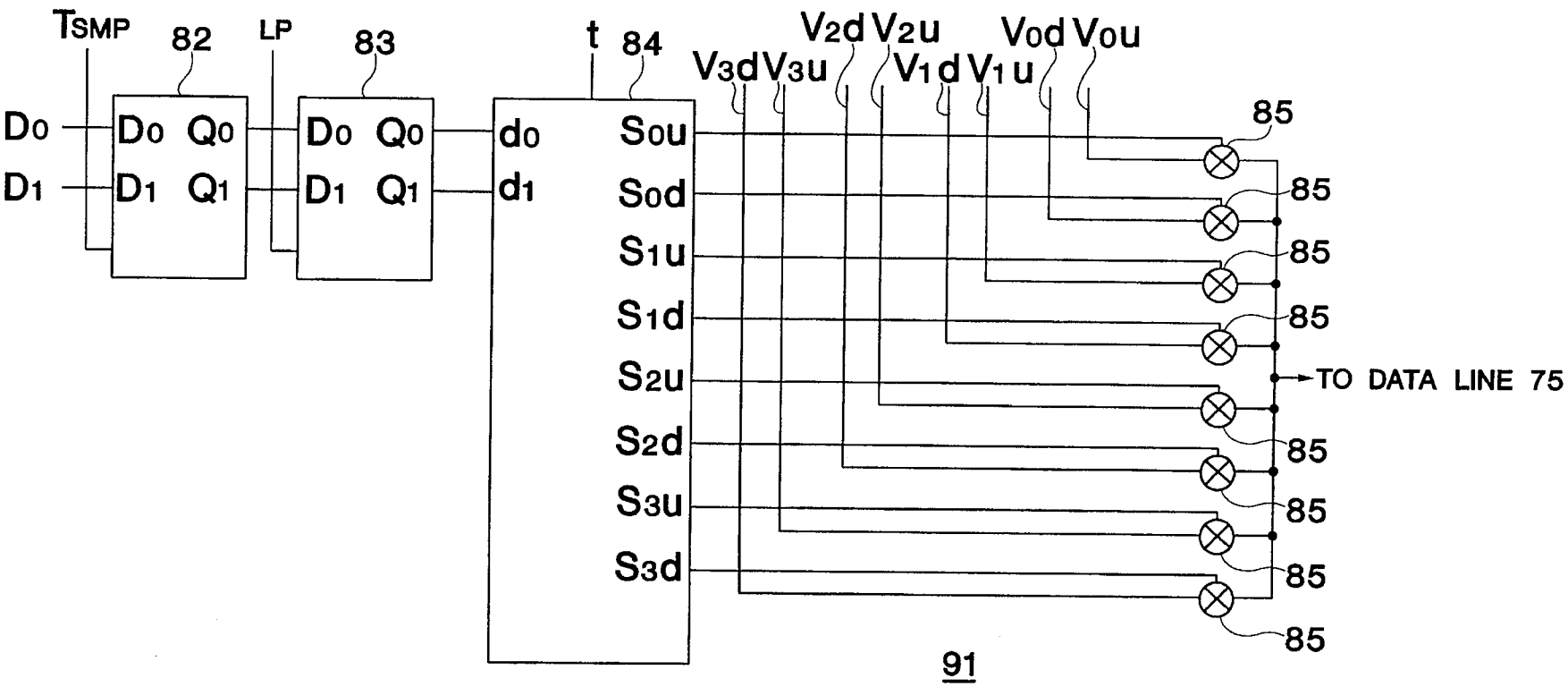
FIG. 9 is a diagram showing part of another construction of a data driver in the first example.

FIG. 9 shows the construction of an output circuit 91 corresponding to one output of the data driver 73. The construction of the output circuit 91 shown in FIG. 9 is the same as that of the output circuit shown in FIG. 8, except that the resistance $r_c$ is omitted, and an oscillating pulse t, which oscillates between the active state end the inactive state at the duty ratio of 1:1, is input into the selection control circuit 84. Therefore, like components are indicated by like reference numerals, and the descriptions thereof are omitted.

Table 2 below is a logic table indicating the relationship between the values of the gray-scale data ($d_0$, $d_1$) input into the selection control circuit 84 and the control signals ($S_{0u}$, $S_{0d}$, $S_{1u}$, $S_{1d}$, $S_{2u}$, $S_{2d}$, $S_{3u}$, $S_{3d}$) output from the selection control circuit 84. As indicated in Table 2, the selection control circuit 84 outputs a control signal so that any one control signal pair of four control signal pairs ($S_{iu}$ and $S_{id}$; i=0, 1, 2, and 3) is set to be "t" and "$\bar{t}$". In Table 2, "t" indicates that the oscillating pulse t is output as the control signal, and "$\bar{t}$" indicates that a signal inverted from the oscillating pulse t is output as the control signal.

TABLE 2

| $d_0$ | $d_1$ | $S_{0u}$ | $S_{0d}$ | $S_{1u}$ | $S_{1d}$ | $S_{2u}$ | $S_{2d}$ | $S_{3u}$ | $S_{3d}$ |
|---|---|---|---|---|---|---|---|---|---|
| 0 | 0 | t | $\bar{t}$ | 0 | 0 | 0 | 0 | 0 | 0 |
| 0 | 1 | 0 | 0 | t | $\bar{t}$ | 0 | 0 | 0 | 0 |
| 1 | 0 | 0 | 0 | 0 | 0 | t | $\bar{t}$ | 0 | 0 |
| 1 | 1 | 0 | 0 | 0 | 0 | 0 | 0 | t | $\bar{t}$ |

The selection control circuit 84 operates in accordance with the logic table in Table 2. As a result, the paired analog switches 85 are alternately turned ON and OFF at a predetermined cycle. Accordingly, as in the equivalent circuit shown in FIG. 4, the absolute value of the current flowing from the four pairs of voltage supply lines 72 to the output circuit 91 is substantially equal to the absolute value of the current flowing from the output circuit 91 to the four pairs of voltage supply lines 72. Therefore, an oscillating voltage having a mean value which is equal to one of the voltages $(V_{0u}+V_{0d})/2$, $(V_{1u}+V_{1d})/2$, $(V_{2u}+V_{2d})/2$, and $(V_{3u}+V_{3d})/2$ is output to the data line 75.

At least one of a set of resistance and capacitance components of the picture element 74 or a set of resistance and capacitance components of the data line 75 connected to the picture element 74 functions as a low pass filter. Thus, the oscillating voltage output to the data line 75 is averaged by the low pass filter. As a result, in the steady state, a voltage which is substantially equal to a mean value of the oscillating voltage is applied to the picture element 74.

As described above, according to the display apparatus of the invention, even when the line resistance of the voltage supply line is relatively high because the voltage supply line is formed on the glass substrate, a voltage equal to one of the desired gray-scale voltages $V_0$, $V_1$, $V_2$, and $V_3$ can be supplied to the plurality of data lines 75. Accordingly, it becomes possible to realize a display apparatus which performs a display with continuous and uniform gray scales.

Figure 10:
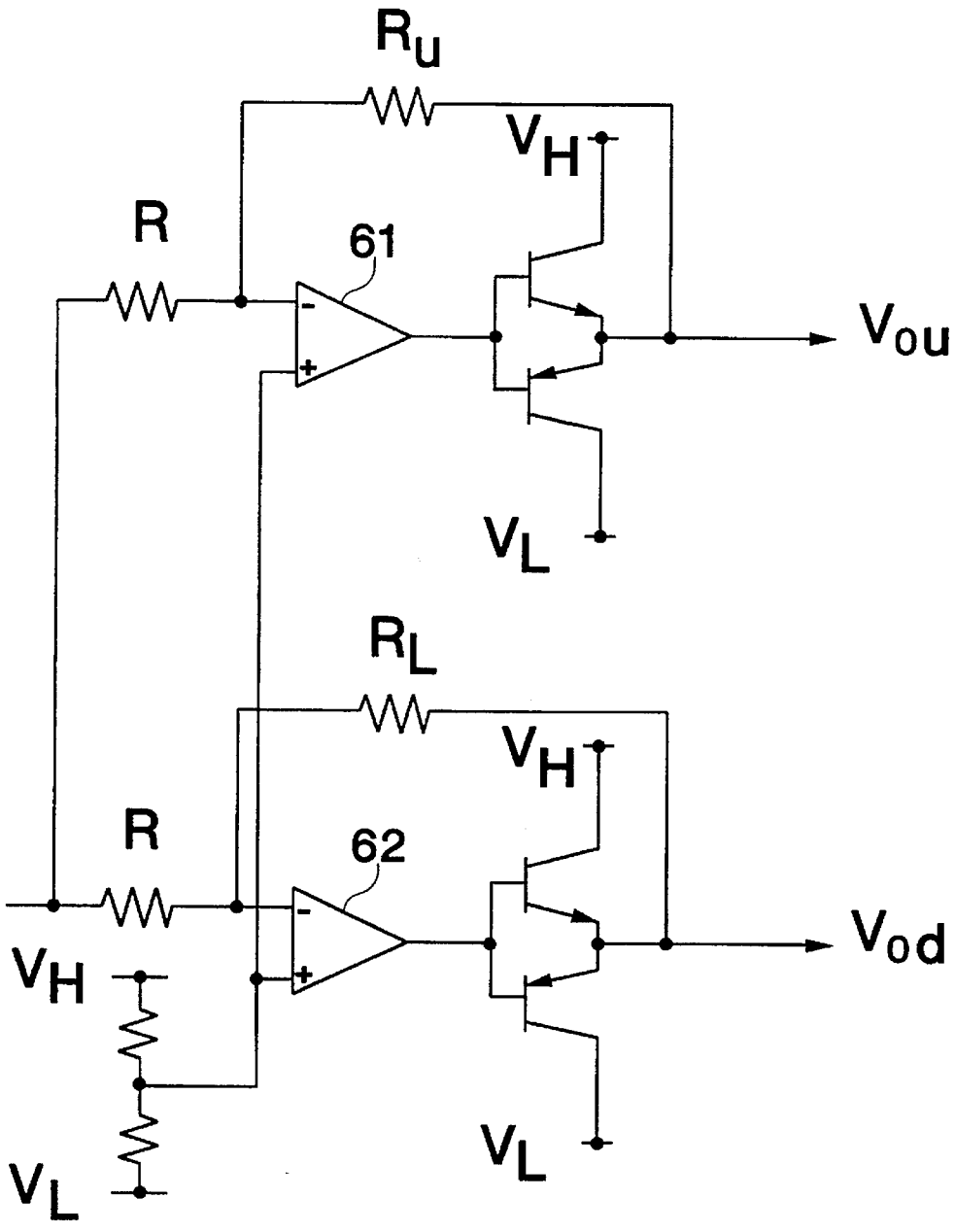
FIG. 10 is a diagram showing the construction of a control power supply circuit.

FIG. 10 shows a part of the construction of the control power supply circuit 71. The construction shown in FIG. 10 is used for supplying a pair of voltages ($V_{0u}$, $V_{0d}$). However, the present invention is not limited by the specific construction of the control power supply circuit 71. Any type of control power supply circuit 71 can be used as far as the eight levels of analog voltages mentioned above are supplied to the four pairs of voltage supply lines 72, respectively.

Figure 11:
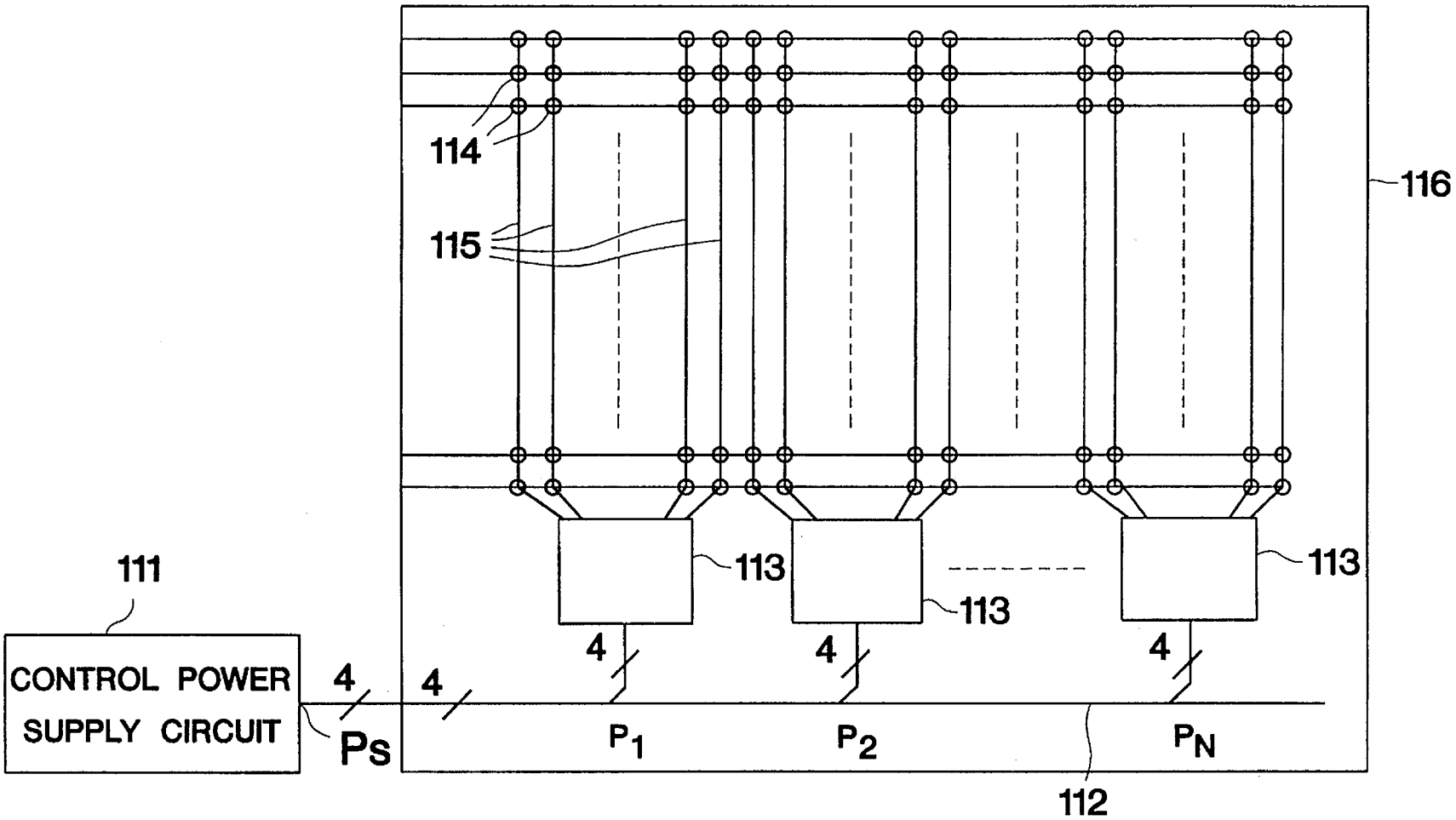
FIG. 11 is a diagram showing the construction of a display apparatus in a second example of the invention.

FIG. 11 shows the construction of a display apparatus in another example of the invention. The display apparatus displays an image with a plurality of levels of gray scales depending on the input gray-scale data. Hereinafter, to simplify the description, it is assumed that the gray-scale data is composed of 2 bits, and the number of levels of the gray scales is 4 ($=2^2$).

The display apparatus includes a control power supply circuit 111 for supplying a plurality of gray-scale voltages, four voltage supply lines 112 connected to the control power supply circuit 111, a plurality of data drivers 113 connected to the four voltage supply lines 112, a plurality of picture elements 114 arranged in a matrix, and a plurality of data lines 115 respectively connected to the picture elements 114. The four voltage supply lines 112, the plurality of data drivers 113, the plurality of picture elements 114, and the plurality of data lines 115 are formed on a glass substrate of a liquid crystal display panel 116.

Herein, a voltage-supplied portion shown in FIG. 5 corresponds to a portion including a data driver 113 connected to the four voltage supply lines 112, a plurality of data lines 115 connected to the data driver 113, and picture elements 114 connected to the data lines 115.

The four voltage supply lines 112 consist of a first voltage supply line $L_0$, a second voltage supply line $L_1$, a third voltage supply line $L_2$, and a fourth voltage supply line $L_3$. The first voltage supply line $L_0$ has an end point $P_{s0}$. The second voltage supply line $L_1$ has an end point $P_{s1}$. The third voltage supply line $L_2$ has an end point $P_{s2}$. The fourth voltage supply line $L_3$ has an end point $P_{s3}$. In FIG. 11, for simplicity, the four end points $P_{s0}$, $P_{s1}$, $P_{s2}$, and $P_{s3}$ are collectively represented as $P_s$. The control power supply circuit 111 applies four levels of analog voltages $V_{osc0}$, $V_{osc1}$, $V_{osc2}$, and $V_{osc3}$ to the four end points $P_{s0}$, $P_{s1}$, $P_{s2}$, and $P_{s3}$, respectively. The oscillating voltage $V_{osci}$ is a voltage which oscillates between a predetermined pair of analog voltages ($V_{iu}$, $V_{id}$) at the duty ratio of 1:1, and oscillates a plurality of times in one output period. Each pair of analog voltages ($V_{iu}$, $V_{id}$) are used for supplying a desired voltage $V_i$ to the data driver 113. The analog voltage $V_{iu}$ is higher than the desired voltage $V_i$ by a predetermined value. The analog voltage $V_{id}$ is lower than the desired voltage $V_i$ by the predetermined value. The predetermined value is previously set so as to be equal to or larger than the maximum voltage drop with respect to the analog voltage $V_{iu}$. Herein, i=0, 1, 2, and 3.

Each of the plurality of data drivers 113 is connected to the four voltage supply lines 112 at respective one of the points $P_1$ to $P_N$. Herein, each of the points $P_1$ to $P_N$ collectively indicates the four end points, as described above. To each of the plurality of data drivers 113, four levels of oscillating voltages are supplied from the control power supply circuit 111 via the four voltage supply lines 112. When the number of data lines 115 connected to one data driver 113 is n, the data driver 113 includes n output circuits. Each of the n output circuits is connected to one data line 115, and outputs a driving voltage to the data line 115 in accordance with the input gray-scale data. The driving voltage is applied to the picture elements 114 via the data line 115.

In order to simplify the description of the construction of the invention, scanning drivers for scanning the plurality of picture elements 114 or signal lines other than the voltage supply lines are not shown in FIG. 11.

In this example, the plurality of data drivers 113 are disposed on one side of the matrix of the picture elements 114. However, the present invention is not limited by the specific location of the data drivers 113. For example, the plurality of date drivers 113 are disposed on the other side of the matrix of the picture elements 114.

In FIG. 11, in order to easily understand the invention, the plurality of data drivers 113 are shown so as to be separately disposed from the four voltage supply lines 112. However, in the actual design, the plurality of data drivers 113 are preferably disposed so as to cover a part of the four voltage supply lines 112. Such a design will prevent voltage supply lines and lines from the voltage supply lines to data drives from crossing each other on the substrate.

Figure 12:
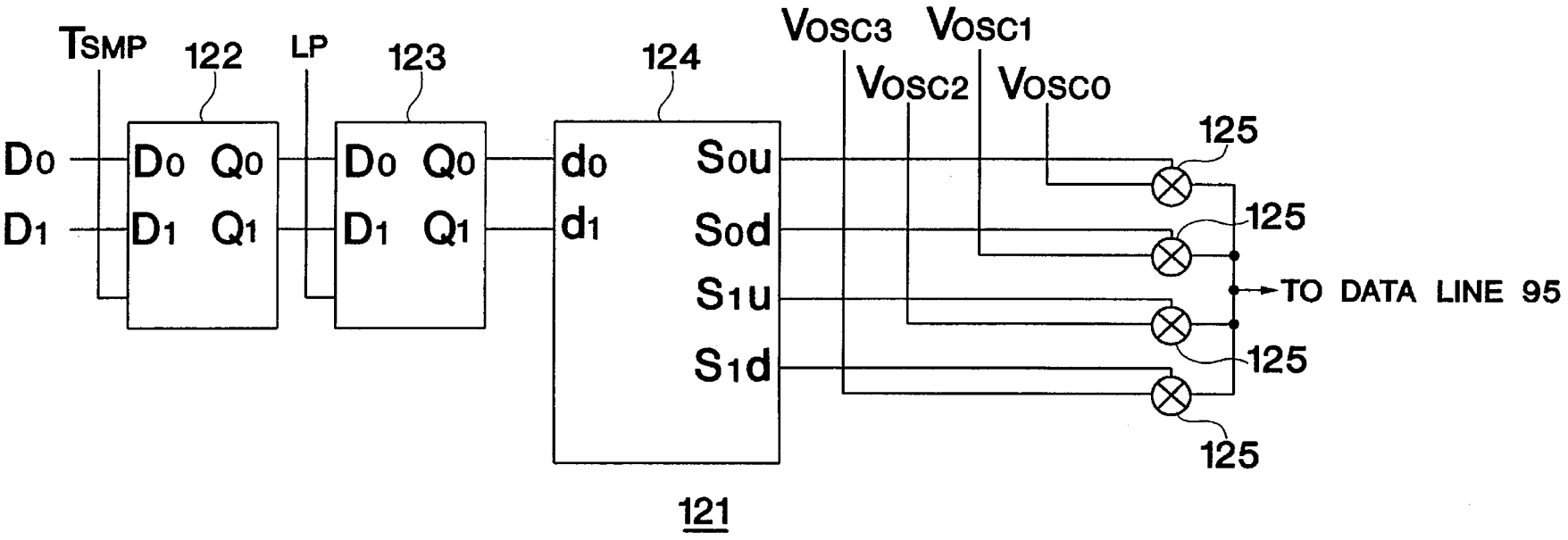
FIG. 12 is a diagram showing part of the construction of a data driver in the second example.
Figure 13:
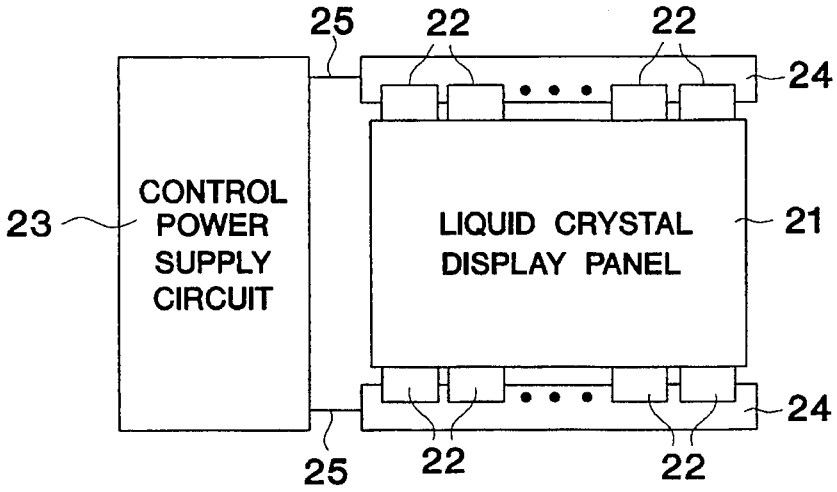
FIG. 13 PRIOR ART
FIG. 13 is a diagram showing the construction of a conventional liquid crystal display apparatus.
Figure 14:
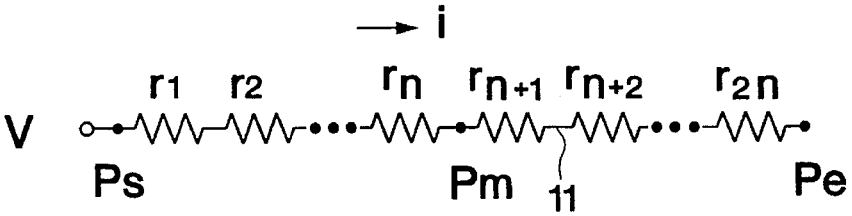
FIG. 14 PRIOR ART
FIG. 14 shows the resistance distribution of the voltage supply line.
Figure 15:
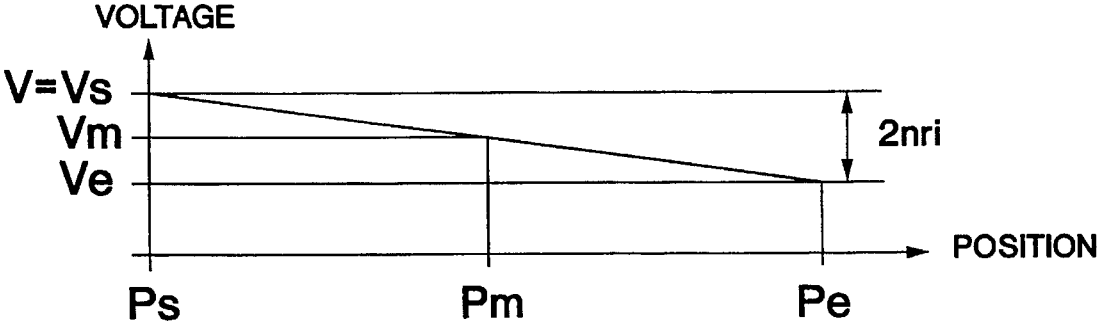
FIG. 15 PRIOR ART
FIG. 15 is a diagram showing the voltage drop caused by a resistance of a voltage supply line.

FIG. 12 shows the construction of an output circuit 121 corresponding to one output of the data driver 113.

The output circuit 121 includes a sampling circuit 122 at a first stage, a holding circuit 123 at a second stage, a selection control circuit 124, and four analog switches 125.

The selection control circuit 124 receives the 2-bit gray-scale data, and outputs a control signal indicating an oscillating voltage to be selected depending on the values of the gray-scale data.

Table 3 below is a logic table indicating the relationship between the values of the gray-scale data ($d_0$, $d_1$) input into the selection control circuit 124 and the control signals ($S_0$, $S_1$, $S_2$, $S_3$) output from the selection control circuit 124. As indicated in Table 3, the selection control circuit 124 outputs a control signal so that any one control signal of four control signals ($S_0$, $S_1$, $S_2$ and $S_3$) is set to be "1" (i.e., become active).

TABLE 3

| $d_0$ | $d_1$ | $S_0$ | $S_1$ | $S_2$ | $S_3$ |
|---|---|---|---|---|---|
| 0 | 0 | 1 | 0 | 0 | 0 |
| 0 | 1 | 0 | 1 | 0 | 0 |
| 1 | 0 | 0 | 0 | 1 | 0 |
| 1 | 1 | 0 | 0 | 0 | 1 |

The outputs of the selection control circuit 124 are connected to the control inputs of the four analog switches 125, respectively. Each of the four analog switches 125 is controlled so that it is turned ON when the value "1" is received at the control input, and it is turned OFF when the value "0" is received at the control input.

The signal inputs of the four analog switches 125 are connected to the four voltage supply lines 112. Accordingly, four levels of oscillating voltages $V_{osc0}$, $V_{osc1}$, $V_{osc2}$, and $V_{osc3}$ are input to the analog switches 125 via the four voltage supply lines 112, respectively.

The selection control circuit 124 operates in accordance with the logic table shown in Table 3. Now, assume that only the control signal $S_0$ is "1" (active). In this case, during a period in which the voltage $V_{u0}$ is applied to the end point $P_{s0}$ of the first voltage supply line $L_0$, a current $i_1$ flows from the point $P_{s0}$ to the output circuit 121 which is connected to the point $P_1$. Then, during a period in which the voltage $V_{d0}$ is applied to the end point $P_{s0}$ of the first voltage supply line $L_0$, the current $i_1$ flows from the output circuit 121 to the point $P_{s0}$. Accordingly, the voltage drop and the voltage rise, caused by the line resistance of the voltage supply line $L_0$, are equal to each other. Thus, the oscillating voltage having a mean value which is substantially equal to $(V_{u0}+V_{d0})/2$ is applied to the point $P_1$, and the oscillating voltage is output to the data line 115.

If any one of the other control signals $S_1$–$S_3$ is "1" (active), the currents flow in the same manner as those described above. Therefore, any one of oscillating voltages which have mean values equal to the voltages $(V_{0u}+V_{0d})/2$, $(V_{1u}+V_{1d})/2$, $(V_{2u}+V_{2d})/2$, and $(V_{3u}+V_{3d})/2$ is output to the data line 115.

At least one of a set of resistance and capacitance components of the picture element 114 or a set of resistance and capacitance components of the data line 115 connected to the picture element 114 functions as a low pass filter. Thus, the oscillating voltage output to the data line 115 is averaged by the low pass filter. As a result, in the steady state, a voltage, which is substantially equal to a mean value of the oscillating voltage, is applied to the picture element 114.

As described above, according to the display apparatus of the invention, even when the line resistance of the voltage supply line is relatively high because the voltage supply line is formed on the glass substrate, an oscillating voltage having a mean value equal to one of the desired gray-scale voltages $V_0$, $V_1$, $V_2$, and $V_3$ can be supplied to the plurality of data lines 115. Accordingly, it becomes possible to realize a display apparatus which performs a display with continuous and uniform gray scales.

The display apparatus shown in FIG. 11 has an advantage in that the number of voltage supply lines can be halved as compared with the display apparatus shown in FIG. 7.

The voltage compensation circuit according to the invention is useful for supplying a desired level of gray-scale voltage to a picture element of a liquid crystal display apparatus. However, the applications of the voltage compensation circuit of the invention are not limited to the above-described specific examples. The voltage compensation circuit according to the invention is useful for any type of circuit which requires a predetermined level of voltage to be supplied irrespective of the distances from one end of the voltage supply lane.

Various other modifications will be apparent to and can be readily made by these skilled in the art without departing from the scope and spirit of this invention. Accordingly, it is not intended that the scope of the claims appended hereto be limited to the description as set forth herein, but rather that the claims be broadly construed.

What is claimed is:

1. A voltage compensation circuit for supplying a desired voltage to a portion to which the desired voltage is to be supplied, by compensating for voltage drops caused by line resistances of voltage supply lines, the voltage compensation circuit comprising:

a first voltage supply line having a first end;

a second voltage supply line having a second end;

wherein a first voltage which is higher than the desired voltage by a predetermined value is applied to the first end, and a second voltage which is lower than the desired voltage by the predetermined value is applied to the second end and;

a first junction connecting the portion to which the desired voltage is to be supplied to the first voltage supply line; and a second junction connecting the portion to which the desired voltage is to be supplied to the second voltage supply line, wherein an amount of voltage drop in the first voltage from the first end to the first junction is substantially equal to an amount of voltage rise in the second voltage from the second end to the second junction, thereby compensating for voltage drops caused by line resistances of said first and second voltage supply lines.

2. A voltage compensation circuit according to claim 1, wherein the line resistance of the first voltage supply line is substantially equal to the line resistance of the second voltage supply line.

3. A voltage compensation circuit according to claim 1, wherein the predetermined value is (2nri) where (2nri) is the maximum voltage drop and the maximum voltage rise for the first and second voltages, respectively.

4. A voltage compensation circuit for supplying a desired voltage to a portion to which the desired voltage is to be supplied, by compensating for a voltage drop caused by a line resistance of a voltage supply line, the voltage compensation circuit comprising:

a voltage supply line having an end, wherein an oscillating voltage unit which oscillates between a first voltage which is higher than the desired voltage by a predetermined value and a second voltage which is lower than the desired voltage by the predetermined value is applied to the end; and a junction connecting the portion to which the desired voltage is to be supplied and the voltage supply line, thereby compensating for the voltage drop caused by the line resistance of the voltage supply line.

5. A voltage compensation circuit according to claim 4, wherein the oscillating voltage is a voltage which oscillates between the first voltage and the second voltage at a duty ratio of 1:1.

6. A voltage compensation circuit according to claim 4, wherein the predetermined value is (2nri) where (2nri) is the maximum voltage drop and the maximum voltage rise for the first and second voltages, respectively.

7. A display apparatus in which a desired gray-scale voltage is applied to a picture element by compensating for a voltage drop caused by a line resistance of a voltage supply line, the display apparatus comprising:

a display section including a picture element and a data line connected to the picture element;

a first voltage supply line having a first end;

a second voltage supply line having a second end;

a voltage supply circuit for applying a first voltage which is higher than the desired gray-scale voltage by a predetermined value to the first end, and for applying a second voltage which is lower than the desired gray-scale voltage by the predetermined value to the second end; and a driving circuit for outputting a driving voltage to the data line, the driving circuit being connected to the first voltage supply line at a first junction and connected to the second voltage supply line at a second junction, wherein an amount of voltage drop in the first voltage from the first end to the first junction is substantially equal to an amount of voltage rise in the second voltage from the second end to the second junction, thereby compensating for voltage drops caused by line resistance of said first and second voltage supply lines.

8. A display apparatus according to claim 7, wherein the first voltage and the second voltage are supplied to the driving circuit, and the driving circuit includes output means for outputting both the first voltage and the second voltage to the data line during the same time perion.

9. A display apparatus according to claim 7, wherein the first voltage and the second voltage are supplied to the driving circuit, and the driving circuit includes output means for alternately outputting the first voltage and the second voltage to the data line at a predetermined cycle.

10. A display apparatus according to claim 7, wherein the line resistance of the first voltage supply line is substantially equal to the line resistance of the second voltage supply line.

11. A display apparatus according to claim 7, wherein the predetermined value is (2nri) where (2nri) is the maximum voltage drop and the maximum voltage rise for the first and second voltages, respectively.

12. A display apparatus in which a desired gray-scale voltage is applied to a picture element by compensating for a voltage drop caused by a line resistance of a voltage supply line, the display apparatus comprising:

a display section including a picture element and a data line connected to the picture element;

a voltage supply line having an end;

a voltage supply circuit for applying an oscillating voltage which oscillates between a first voltage which is higher than the desired gray-scale voltage by a predetermined value and a second voltage which is lower than the desired gray-scale voltage by the predetermined value to the end; and a driving circuit for outputting a driving voltage to the data line, the driving circuit being connected to the voltage supply line at a junction, thereby compensating for the voltage drop caused by the line resistance of the voltage supply line.

13. A display apparatus according to claim 12, wherein the oscillating voltage is a voltage which oscillates between the first voltage and the second voltage at a duty ratio of 1:1.

14. A display apparatus according to claim 12, wherein the predetermined value is (2nri) where (2nri) is the maximum voltage drop and the maximum voltage rise for the first and second voltages, respectively.

15. A method of compensating for voltage drops caused by line resistances of voltage supply lines, thereby supplying a desired voltage to a portion, comprising the steps of:

applying a first voltage which is higher than the desired voltage by a predetermined value to the portion at a first junction;

applying a second voltage which is lower than the desired voltage by the predetermined value to the portion at a second junction; and providing an amount of voltage drop in the first voltage from a first end of a first voltage supply line to the first junction substantially equal to an amount of voltage rise in the second voltage from a second end of a second voltage supply line to the second junction, thereby compensating for the voltage drop caused by line resistances in said first and second voltage supply lines and supplying the desired voltage to the portion.

16. A method of compensating for a voltage drop caused by a line resistance of a voltage supply line, thereby supplying a desired voltage to a portion, comprising the steps of:

connecting the portion and the voltage supply line; and applying an oscillating voltage which oscillates between a first voltage which is higher than the desired voltage by a predetermined value and a second voltage which is lower than the desired voltage by the predetermined value to the voltage supply line, thereby compensating for the voltage drop caused by the line resistance of the voltage supply line and supplying the desired voltage to the portion.

* * * * *